US007247052B2

(12) United States Patent
Söfker

(10) Patent No.: US 7,247,052 B2
(45) Date of Patent: Jul. 24, 2007

(54) SHIELD CONNECTION

(75) Inventor: Jörg Söfker, Lemgo (DE)

(73) Assignee: Phoenix Contact GmbH & Co. KG (DE)

( * ) Notice: Subject to any disclaimer, the term of this patent is extended or adjusted under 35 U.S.C. 154(b) by 0 days.

(21) Appl. No.: 10/575,149

(22) PCT Filed: Oct. 8, 2004

(86) PCT No.: PCT/EP2004/011243

§ 371 (c)(1),
(2), (4) Date: Apr. 7, 2006

(87) PCT Pub. No.: WO2005/036700

PCT Pub. Date: Apr. 21, 2005

(65) Prior Publication Data

US 2007/0054549 A1 Mar. 8, 2007

(30) Foreign Application Priority Data

Oct. 8, 2003 (DE) ..... 103 47 306

(51) Int. Cl.
*H01R 13/648* (2006.01)

(52) U.S. Cl. ..... 439/607; 439/95

(58) Field of Classification Search ..... 439/95, 439/108, 607, 609

See application file for complete search history.

(56) References Cited

U.S. PATENT DOCUMENTS 5,017,158 A 5/1991 Liu et al.
5,885,103 A 3/1999 Ernolf et al.
6,227,904 B1 5/2001 Wang et al.

FOREIGN PATENT DOCUMENTS

| | | |
|---|---|---|
| DE | 3843948 | 7/1990 |
| DE | 4003069 | 8/1991 |
| DE | 298 05 316 | 6/1998 |
| DE | 197 34 422 | 2/1999 |
| FR | 1250743 | 1/1960 |
| FR | 2 836 293 | 8/2003 |

OTHER PUBLICATIONS

International Search Report for Application No. PCT/EP2004/011243, dated Feb. 22, 2005.
International Preliminary Report on Patentability in Application No. PCT/EP2004/011243, dated Jul. 27, 2006.

*Primary Examiner*—Khiem Nguyen
(74) *Attorney, Agent, or Firm*—Bourque and Associates

(57) ABSTRACT

A shield connection between a pc-board for electrical and/or electronic components located in a housing and at least one connector socket located in a wall of the housing with a metal cylindrical socket casing that passes through the housing wall includes a receiving device for a plug with a corresponding metal coupling component, which is electrically connected with the shield of a cable connected to the plug. To create a shielded connection, the shield potential is automatically distributed further by the connection to the housing The shield connection consists of a metal ring-shaped shield element, which includes contact pins for the electrical and mechanical connection with the pc-board. The contact pins each protrude from the ring plane on the one ring side, with the spring tongues protruding on the other side of the ring for electrical and mechanical contact with the socket casing.

15 Claims, 4 Drawing Sheets

SHIELD CONNECTION

TECHNICAL FIELD

The invention relates to a shield connection between a pc-board located in a housing and at least one connector socket located in a wall of a housing.

BACKGROUND INFORMATION

It is generally known to improve and simplify the electrically conducting coupling of an electrical lead shielding for connections to equipment provided within a housing. To this end, document DE 298 05 316 U1 describes an angle-shaped shield element with a spring contact that is located in the area of a housing entry of a shielded electrical lead, in order to establish a shield connection to the housing without additional expenditure of time when connecting the shield to the housing. Known from document DE 197 34 422 A1 are shield elements that are provided for connector devices with shielded electrical lines and that have the shape of protective caps or rectangular housings that must be plugged into a mounting frame.

SUMMARY

It is an objective of the invention to create a shielded connection of the aforementioned kind, where the electrical connection of the socket casing of the connector socket that contacts electrically the potential of the shield of the cable to be connected to the pc-board across which the shield potential is distributed further, such that it occurs automatically when joining the housing.

This objective is achieved by a shield connection and in particular, a ring-shaped shield element. The ring-shaped shield element which is the subject of the invention allows for a particularly easy establishment of the shield connection of the pc-board to the metal socket casing of the connector socket. The shield element is plugged onto the respective pc-board with its contact members in that location, where the axis that passes vertically through the ring plane of the shield element meets the axis of the associated connector socket in the closed position of the housing. In this manner, during the assembly of the housing the pc-boards that are located inside the housing and the housing panel that carries the connector socket are brought together electrically relative to one another such that the socket casing of the connector socket, which protrudes on the inside of the housing wall, will automatically be inserted between the spring tongues of the shield element under expansion. An additional advantage is that the shield element can be manufactured easily. Only a few bending steps need to be provided when punching out of a steel sheet, in order to bring the contact members and spring tongues that protrude from the ring plane into their functional positions. In this manner, several or multiple shield elements can be manufactured simultaneously and can be separated easily for individual use or can be used together as connected shield elements to establish the shield connection at several connector sockets in the respective housing wall simultaneously, with the configuration of the shield elements that are connected to one another being easily adjusted to the configuration of said connector sockets.

It is important to note that the present invention is not intended to be limited to a system or method which must satisfy one or more of any stated or implied objects or features of the invention. It is also important to note that the present invention is not limited to the preferred, exemplary, or primary embodiment(s) described herein.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
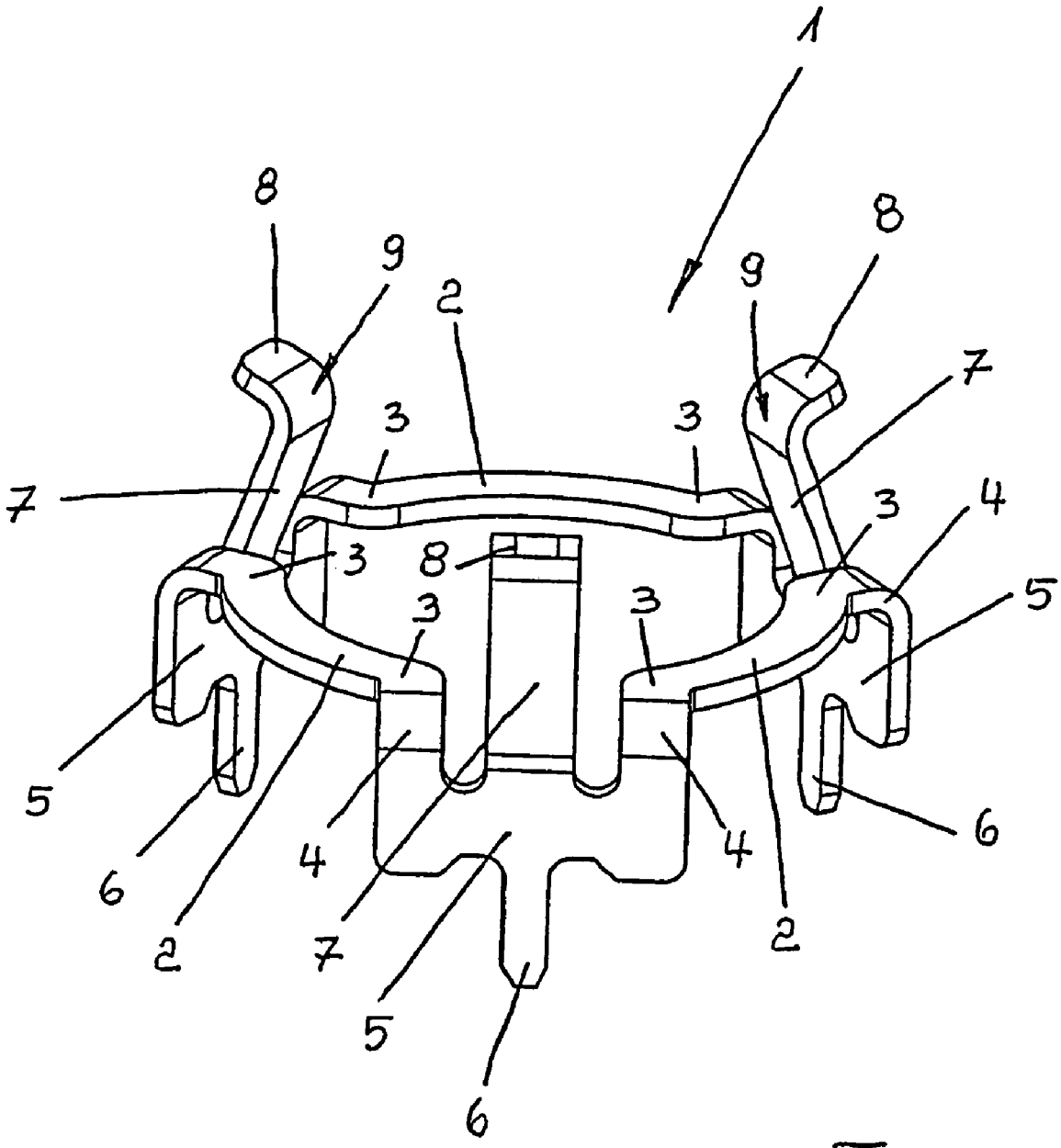
FIG. 1 FIG. 1 shows a perspective presentation of a ring-shaped shield element according to the present invention.

FIG. 1 in particular shows a shield element 1, which is punched out of a flat steel sheet together with its integrated components and which is partially bent in the manner explained below. The shield element 1 has the basic shape of a circular ring, which is provided by the circular progression of flat webs 2. The flat webs 2 have a width that is significantly greater than its thickness, which is determined by the thickness of the steel sheet from which the shield element 2 has been punched. The flat webs 2 that form the ring sections are arranged in a flat manner in the ring plane.

At each end, the flat webs 2 exhibit offsets 3, which are directed away from the ring center and connect to the bending 4. The bendings 4 continue as interim webs 5, which are flat and stand perpendicular to the ring plane of the shield element 1 which is the same generally as the plane in which the flat webs 2 are arranged. The interim webs 5 are at a certain distance from this ring plane and they are followed by contact members 6 in the form of contact pins or contact pads in the center in the direction away from the ring plane. The contact members 6 thus protrude on the one ring side of the shield elements 1 with regard to the ring plane and extend in a parallel direction to the axis that goes vertically through the center of the ring plane.

Spring tongues 7 with lengths that are designed such that they protrude at the second ring side with regard to the ring plane of the shield element 1 follow the interim webs 5 on the side that is away from the contact members 6. In their initial position, the spring tongues 7 are sloping slightly towards the inside in the direction of the axis that goes through the center of the ring plane. On their free ends, the spring tongues exhibit end sections 8 that are angled toward the outside, with contact areas 9 being located in the bending sections at the inside of the spring tongues 7 towards the angled end sections 8 that are provided for the electrical connection described below.

Overall, the shield element 1 is a rotationally symmetric formation with regard to the axis that goes vertically through the center of the ring plane. Preferably, the shield element 1 has three, four or an even greater number of angled interim webs 5 with contact members 6 and spring tongues 7.

Figure 2:
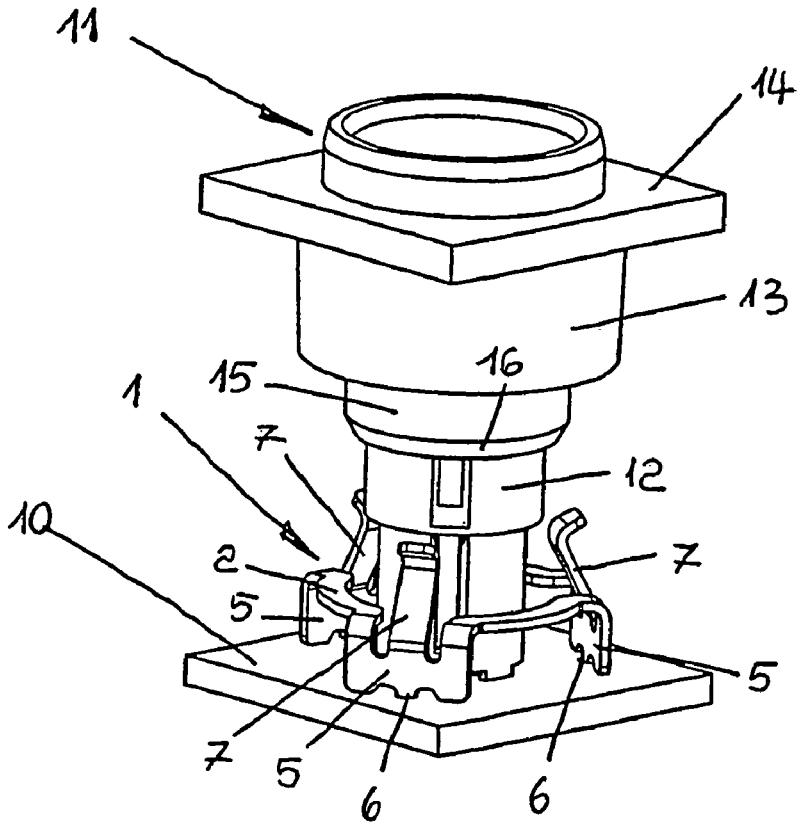
FIG. 2 shows a perspective presentation of the shield element according to FIG. 1 in an arrangement that is mounted to a pc-board prior to being joined with the corresponding connector socket in a housing wall.

As FIG. 2 illustrates, in its operational position, the shield element 1 is pushed onto a pc-board 10. The shielding potential that is being obtained from the shield element 1, is distributed by the pc-board 10 in a suitable manner to obtain optimal shielding as is well known in the art. The mechanical attachment and the electrical contact of the shield element 1 on the pc-board 10 occur via the contact members 6 which may be formed as solder pins for this purpose. Coaxially to the shield element 1 with regard to the axis that goes vertically through the center of the ring plane of the shield element 1, a contact carrier 12 comprised of a connector socket 11 is placed positively on the pc-board 10. A metal socket casing 15, designed as a hollow cylinder, is an additional part of the connector socket 11. The socket casing 15 is positively inserted in a cylindrical shoulder 13 at a wall 14 that belongs to a housing holding the pc-board and is not shown in the drawing in its entirety. It is crucial that during assembly or joining of the housing, the housing wall 14 and the pc-board 10 are aligned to one another and can be moved toward each other such that the socket casing 15 that surrounds the contact carrier 12 is coaxially aligned with the shield element 1 and can be moved until contact is made with the shield element 1.

Figure 3:
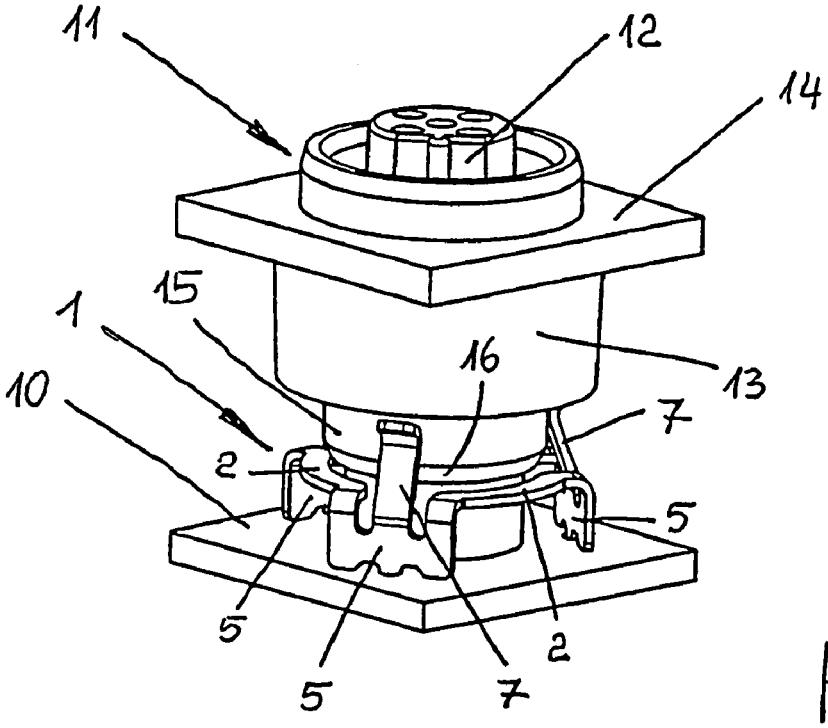
FIG. 3 shows a presentation corresponding to FIG. 2 in the joined arrangement of the shield element and the connector socket.

The socket casing 15 of the connector socket 11 protrudes on the inside of the housing wall 14 and has an inside end that is provided with a bevel 16 at its outer side towards its free face side. When joining the connector socket 11, the inside end of the socket casing 15 moves between the spring tongues 7 of the shield element 1 and expands said spring tongues. Thus, the inside end of the socket casing 15 exhibits an outside diameter that is greater than the diameter of that circle on which the inner contact locations 9 are located at the spring tongues 7 of the shield element 1 in the initial position. As FIG. 3 shows, this ensures a secure contact of the spring tongues 7 on the inside of the socket casing 15.

The socket casing 15 of the connector socket 11 has a female or male thread corresponding to the desired connection type and is accessible from the outside of the housing wall for connecting a plug, which exhibits a corresponding thread component for a screw connection with the socket casing 15 of the connector socket 11. This thread component of the plug in turn is in the usual manner connected with the shield of an electric lead in a cable, such that when the plug is placed on the connector socket 11, an electrical connection exists between the lead shield and the shield element 1.

Figure 4:
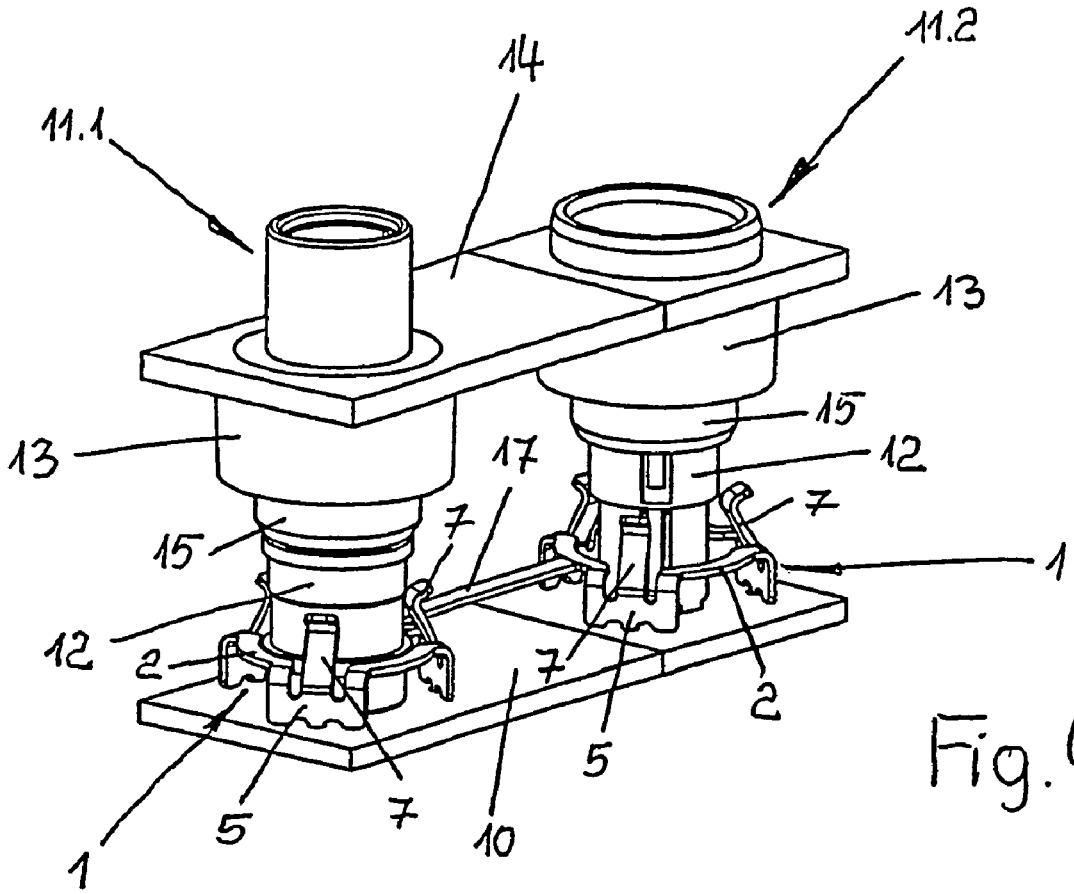
FIG. 4 shows a presentation corresponding to FIG. 2 of two joined shield elements for two connector sockets located adjacent to one another prior to being joined.
Figure 5:
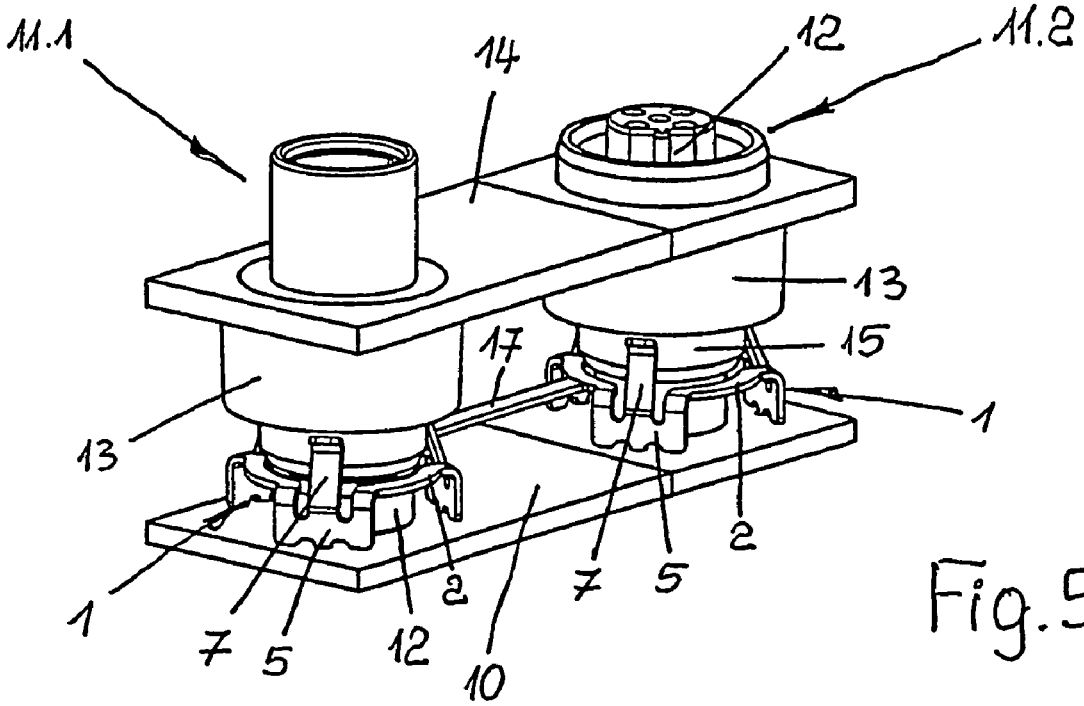
FIG. 5 shows the arrangement of the shield elements and connector sockets according to FIG. 4 in the joined arrangement.

FIGS. 4 and 5 serve as illustration of a connector socket 11.1 and a connector socket 11.2 each, where the socket casing 15 of the connector socket 11.1 is provided with a male thread and that of the connector socket 11.2 with a female thread. In addition, FIGS. 4 and 5 reveal that the shield elements 1 that are assigned to the two connector sockets 11.1 and 11.2 are connected to one another in one piece via connection webs 17. This provides better shielding with several leads into the respective housing and onto the associated pc-board. Principally, if only one connection of the shield elements between two or more connector sockets 11 is necessary, the contact members 6 at the shield elements 1 can remain unused or may even be omitted. In this case, the shield sheets 1 are simply plugged onto the socket casings 15 of the connector sockets 11.

Figure 6:
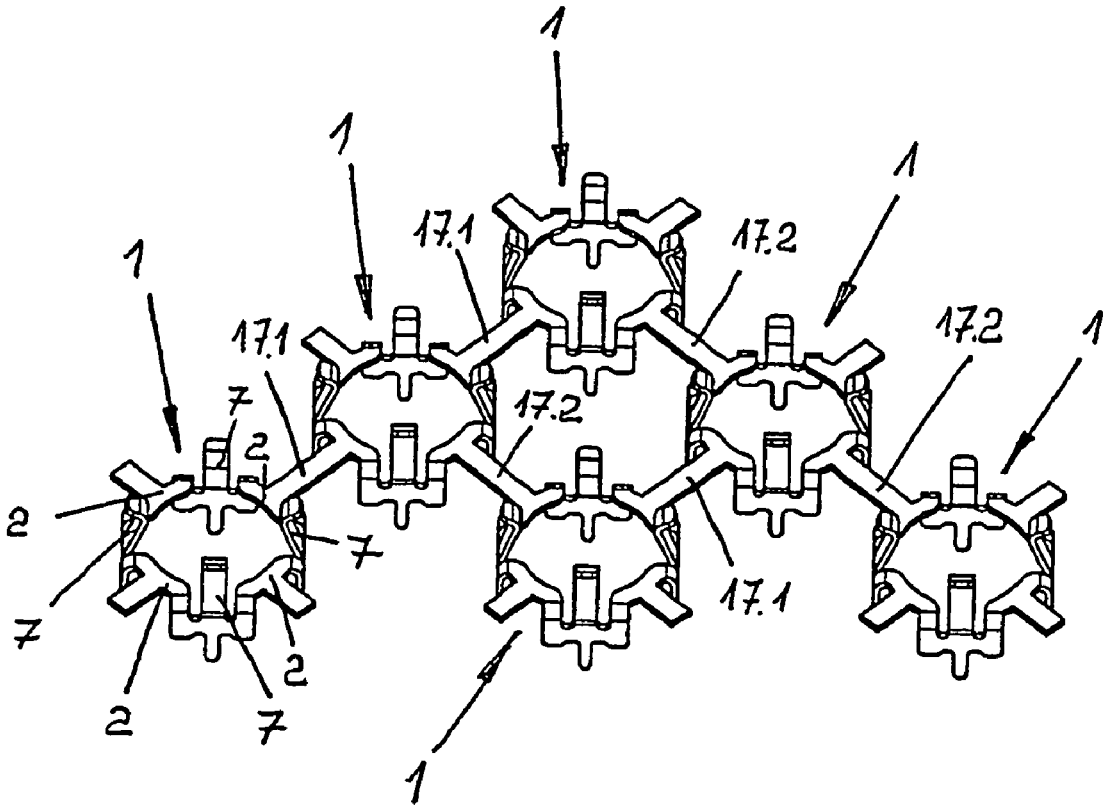
FIG. 6 shows a perspective presentation of a multitude of shield elements in a joined one-piece arrangement.

FIG. 6 shows a multitude of the shield elements 1, which are connected to one another in one piece via the connection webs 17. This arrangement provides for efficient manufacturing of the shield elements 1, which, if required, can also be used individually by cutting the connection webs 17. On the other hand, the connected shield elements 1 can be used as a group, as long as they have such distances to one another that correspond to the arrangement of connector sockets arranged to one another accordingly. Both in individual use and when used as a group, the spring tongues 7 of the shield elements 1 compensate for possible tolerances at the socket casings 15 of the connector sockets 11, or in the arrangement of several connector sockets to one another, due to their elasticity.

The several or multiple shield elements 1 can be manufactured in the shape of a grid field or band. In the example shown in FIG. 6, the shield elements 1 have four flat webs 2 each; correspondingly, the other components of the shield elements 1 are present fourfold. In radial direction, the connection webs 17 preferably follow the flat webs at the center; thus, each two adjacent connection webs 17 form a 90-degree angle to one another. Accordingly, at the grid field, there are two alignment directions for the connection webs 17, which also create a 90-degree angle to one another. The connection webs 17.1 and 17.2 are each arranged in one of these two alignment directions and are of equal length; in the same manner, the connection webs 17.1 and 17.2 that are located in the two different alignment directions may be of equal length but may also have different lengths. This depends on the configuration of the connector sockets 11 as they are provided on the housing of the respective device, especially a sensor/actor box.

Modifications and substitutions by one of ordinary skill in the art are considered to be within the scope of the present invention, which is not to be limited except by the allowed claims and any legal equivalents thereof.

I claim:

1. A shield connection between a pc-board for electrical and/or electronic components located in a housing and at least one connector socket located in one of the walls of the housing with a metal cylindrical socket casing that passes through the housing wall and that exhibits on the outside of the wall a receiving device for a plug with a corresponding metal coupling component, which is electrically connected with the shield of a cable connected to the plug, said shield connection comprising:

a metal ring-shaped shield element (1), having at least two contact members (6) for electrical contact with the pc-board (10) where said contact members each protrude from a ring plane on one ring side, and with at least two spring tongues (7) protruding on the other side of the ring plane opposite the contact members, said spring tongues for electrical and mechanical contact with a socket casing (15).

2. A shield connection as set forth in claim 1, wherein the shield element (1) is a one-piece punched component cut from a steel sheet.

3. A shield connection as set forth in claim 2, wherein said shield connection includes several or numerous shield elements (1) that are punched components cut from the steel sheet in one piece and connected via separable connection webs (17).

4. A shield connection as set forth in claim 3, wherein at least a portion of the connected shield elements (1) are arranged in a configuration to one another that corresponds to that of numerous connector sockets (11) that are arranged together at the respective wall (14) of a housing.

5. A shield connection as set forth in claim 1, wherein the spring tongues (7) of the shield element (1) have contact areas (9) located on a circle which has a diameter that is smaller than a diameter of the socket casing (15) of the connector socket (11) in that contact region.

6. A shield connection as set forth in claim 5, wherein the socket casing (15) of the connector socket (11) in its operational position is moved coaxially to the shield element (1) between the spring tongues (7) of said shield element.

7. A shield connection as set forth in claim 6, wherein the socket component (15) exhibits a bevel (16) at its inside end, which reduces its diameter in the direction of its free end.

8. A shield connection as set forth in claim 5, wherein the spring tongues (7) of the shield element (1) include end sections (8) that follow the contact areas (9) and that are angled from the ring center towards the outside.

9. A shield connection as set forth in claim 1, wherein the contact pins (6) of the shield element (1) protrude perpendicular to the ring plane of the shield element (1).

10. A shield connection as set forth in claim 9, wherein the shield element (1) exhibits flat webs (2) that lie flat between the contact pins (6) and/or the spring tongues (7).

11. A shield connection as set forth in claim 10, wherein a flat interim web (5) is located between the flat webs (2) of the shield element (1), where said interim web is at an angle to said flat webs and perpendicular to the ring plane, and where contact pins (6) and/or spring tongues (7) follow said interim web.

12. A shield connection as set forth in claim 10, wherein there are various or multiple shield elements (1) that are connected to one another in one piece, and wherein the connecting webs (17) are also designed as flat webs that lie flat in the ring plane.

13. A shield connection as set forth in claim 1, wherein the at least one shield element (1) is designed rotationally symmetrical with regard to an axis that goes perpendicular through the center of the ring plane and exhibits at least three flat webs (2), whereby at the interim webs (5), which are located between them, one of the contact pins (6) and one of the spring tongues (7) each are arranged protruding in opposite directions.

14. A shield connection as set forth in claim 12, wherein the shield elements (1) that are connected to one another each exhibit four flat webs (2) that are each followed at the center by the connection webs (17) that are correspondingly offset by 90 degrees to one another, whereby the connection webs (17.1) in the first of the two alignment directions that are offset to one anther by 90 degrees are of equal lengths and the connection webs (17.2) in the second of the two alignment directions are together of equal lengths.

15. A shield connection as set forth in claim 14, wherein the lengths of the connecting webs (17.1) in the first alignment direction and the lengths of the connecting webs (17.2) in the second alignment direction are equal or different.

* * * * *